US006604464B2

(12) United States Patent
Kawabata et al.

(10) Patent No.: US 6,604,464 B2
(45) Date of Patent: Aug. 12, 2003

(54) INKING DEVICE HAVING SPACE ENCLOSED BY ROLLERS FOR CONTAINING INK PARTICLES

(75) Inventors: Takanobu Kawabata, Yokohama (JP); Hiroji Yoshida, Kawasaki (JP); Kazuo Takahara, Yokohama (JP)

(73) Assignee: Tokyo KiKai Seisakusho, Ltd. (JP)

( * ) Notice: Subject to any disclaimer, the term of this patent is extended or adjusted under 35 U.S.C. 154(b) by 0 days.

(21) Appl. No.: 09/770,136

(22) Filed: Jan. 26, 2001

(65) Prior Publication Data

US 2001/0011511 A1 Aug. 9, 2001

(30) Foreign Application Priority Data

Jan. 27, 2000 (JP) ..... 2000-018384

(51) Int. Cl.[7] ..... B41F 31/20

(52) U.S. Cl. ..... 101/350.1; 101/350.5; 101/366

(58) Field of Search ..... 101/348, 349.1, 101/350.1, 350.2, 350.5, 416.1, 363, 364, 366, 351.8

(56) References Cited

U.S. PATENT DOCUMENTS

| | | | | |
|---|---|---|---|---|
| 3,011,435 A | * | 12/1961 | Jones et al. | 101/350.5 |
| 3,624,731 A | * | 11/1971 | Lindberg | 101/352.11 |
| 4,537,127 A | | 8/1985 | Fadner et al. | 101/348 |
| 4,567,827 A | | 2/1986 | Fadner | 101/352.11 |
| 4,601,242 A | | 7/1986 | Fadner | 101/348 |
| 4,862,799 A | | 9/1989 | Hycner et al. | 101/348 |
| RE36,083 E | * | 2/1999 | Spiegel et al. | 101/148 |
| 6,279,474 B1 | * | 8/2001 | Liebl | 101/351.8 |

FOREIGN PATENT DOCUMENTS

| | | |
|---|---|---|
| EP | 0 368 485 | 5/1990 |
| EP | 0 461 426 | 12/1991 |
| JP | Sho-59-35945 | 2/1984 |
| JP | Sho-61-81941 | 5/1986 |

OTHER PUBLICATIONS

Gihodo Publishing Co., Ltd., Jul. 20, 1983, Insatsu Kogaku Binran, p. 687, 1.24–p.688. 1.7.

* cited by examiner

*Primary Examiner*—Leslie J. Evanisko
(74) *Attorney, Agent, or Firm*—McGlew and Tuttle, P.C.

(57) ABSTRACT

An inking device for feeding ink that is fed to an ink rail to a printing plate on a plate cylinder via a group of rollers that are sequentially in contact with each other, comprising a first roller part of the outer periphery of which faces an ink feeding surface of the ink rail, a second roller that is disposed downstream of the first roller in the ink feeding process and in contact with the outer periphery of the first roller on the downstream side in the rotating direction from the position at which the first roller faces the ink feeding surface of the ink rail, a third roller that is in contact with the first roller on the downstream side in the rotating direction from the position at which the second roller comes in contact with the outer periphery of the first roller, and a fourth roller that is in contact with the outer peripheries of the second and third rollers and blocks the front side in the rotating direction of the first and second rollers at the position where the first and second rollers are in contact with each other; ink droplets and ink particles produced at the contact area of the first and second rollers by the rotation thereof being contained in a space enclosed by the first through fourth rollers.

19 Claims, 2 Drawing Sheets

INKING DEVICE HAVING SPACE ENCLOSED BY ROLLERS FOR CONTAINING INK PARTICLES

BACKGROUND OF THE INVENTION

1. Field of the Invention

The present invention relates generally to an inking device for supplying ink that is fed to an ink rail to a printing plate on a plate cylinder via a group of roller that are sequentially in contact with each other, and more particularly to an inking device in which ink droplets and ink particles produced from a relatively thick ink film transferred from the ink rail to the first roller are prevented from scattering to the outside of the printing press.

2. Description of the Prior Art

It is well known that an ink film is often reduced to filaments in between rotating rollers while a printing press is in operation, which then break up into multiple ink droplets and particles, and that these droplets and particles repulse each other due to surface static charges and are scattered and suspended in the air.

In a printing operation under the same operating conditions in terms of ink, speed and working environment, it is also known that thicker ink films are more likely to produce ink droplets and particles (refer to "Insatsu Kogaku Binran" (Printing Engineering Manual), pp.687~688, Gihodo Publishing Co., Ltd., 1983.) These ink droplets and particles tend to contaminate printing presses and their surroundings, soil operators' clothing and aggravate the working environment. They are also likely to contaminate printing paper surface, lowering printing quality.

As a technique to prevent these defects and inconveniences, a technique disclosed in Japanese Published Unexamined Patent Application No. Sho-59(1984)-35945 and Japanese Published Unexamined Utility Model Application No. Sho-61(1986)-81941 is publicly known.

Japanese Published Unexamined Patent Application No. Sho-59(1984)-35945 discloses an inking device having a multitude of ink rollers rotating in contact with each other between an ink feeding section and a plate cylinder, in which ink rollers other than those in the vicinity of the plate cylinder are arranged in such a manner that any one or both of a pair of rollers rotating in contact with each other are disposed in front of the contact area in the rotating direction of another pair of rollers rotating in contact with each other, so that the ink droplets and particles scattered from the contact area of a pair of rollers rotating in contact with each other and suspended in front of both roller in the rotating direction are caused to impinge on those ink rollers provided in front of both rollers in the rotating direction to prevent ink from being scattered and suspended.

Japanese Published Unexamined Utility Model Application No. Sho-61(1986)-81941, on the other hand, discloses an inking device having a group of rollers sequentially coming in contact with each other to feed ink to the plate cylinder, in which high-voltage electrodes are disposed in front of the rollers rotating in contact with each other at predetermined intervals with respect to the contact area of both rollers, with a high voltage source connected to the electrodes so as to apply a high voltage, so that corona discharge is caused to generate by applying a high voltage to form an electrostatic curtain so as to attract the ink droplets and particles scattered and suspended in front of both rollers at the contact area to cause them to redeposit on any of both rollers or accumulate on the electrodes.

There are a number of defects and problems, however, in the techniques disclosed in Japanese Published Unexamined Patent Application No. Sho-59(1984)-35945 and Japanese Published Unexamined Utility Model Application No. Sho-61(1986)-81941, as will be described later.

The technique disclosed in Japanese Published Unexamined Patent Application No. Sho-59(1984)-35945 requires to provide a relatively large number of rollers provided in a limited space, with a roller surrounded on all four sides by other rollers provided to ensure desired operations and effects of the invention. In addition, the technique has poor operability workability since it is extremely difficult to incorporate a mechanism for adjusting roller arrangement and the state of contact of rollers and adjust the state of contact of not only a roller surrounded by other rollers but also some of other rollers by operating the incorporated adjusting mechanism while checking and confirming the state of adjustment. Furthermore, the technique has poor workability since it has some rollers which cannot be changed without disassembling other rollers.

Among ink droplets and particles which are scattered and suspended in various directions as they repulse each other due to surface static charges, those ink droplets and particles that travel toward the outer periphery of the rollers and impinge on the roller outer periphery can be successfully prevented from being scattered and suspended as desired. There are many ink droplets and particles, however, which pass through gaps between rollers due to the aforementioned repulsion force. This makes it difficult to prevent ink droplets and particles from being scattered and suspended.

In the technique disclosed in Japanese Published Unexamined Utility Model Application No. Sho-61(1986)-81941, high-voltage electrodes disposed at predetermined intervals with respect to the contact area in front of rollers rotating in contact with each other at the contact area could interfere with the adjustment of the state of contact between both rollers or the exchange of rollers, posing a workability problem. The electrodes to which a high voltage is applied could attract paper dust with electrostatic attraction, leading to static discharge ignition, presenting fire hazards. Furthermore, the electrodes might be contaminated by the ink droplets and particles passing through the electrostatic curtain and impinging on the electrodes as it is attracted by any force overwhelming the attraction of the electrostatic curtain or by the electrodes of a polarity opposite to that of the static charge. This could necessitate maintenance work to maintain the electrodes in such a clean state as to achieve the desired effects by removing the ink deposited on the electrodes.

In addition to the above, no measures have been available to prevent ink droplets and particles from passing through the electrostatic curtain or the array of electrodes as they are attracted by any force overwhelming the attraction force of the electrostatic curtain or the attraction force exerted by the electrodes of an opposite polarity.

SUMMARY OF THE INVENTION

It is therefore an object of the present invention to provide an inking device having a group of rollers sequentially coming in contact with each other to feed ink to a printing plate on a plate cylinder, in which ink droplets and particles that are mostly generated at the contact area of an ink transfer roller to which ink is transferred in a relatively thick film from the ink rail are prevented from being scattered and suspended outside the printing press; the inking device involving no difficulty in arranging rollers and no fire hazards, having good workability and operability, and requiring no special maintenance work.

It is another object of the present invention to provide an inking device which can prevent the ink droplets and particles generated while a printing press is in operation from being scattered and suspended using a simple mechanical arrangement of rollers.

It is a further object of the present invention to provide an inking device which causes the ink droplets and particles generated while a printing press is in operation to deposit on rollers to recirculate them to the inking device.

In the disclosed embodiments, an inking device for feeding the ink fed to the ink rail to a printing plate on a plate cylinder via a group of rollers sequentially coming in contact with each other, comprises a first roller part of the outer periphery of which faces the ink feeding surface of the ink rail, a second roller disposed downstream of the first roller in the ink feeding process and in contact with the outer periphery of the first roller that is downstream side in the rotating direction from the position at which the first roller faces the ink feeding surface of the ink rail, a third roller coming in contact with the first roller on the downstream side in the rotating direction from the position at which the outer periphery of the first roller is in contact with the second roller, and a fourth roller coming in contact with both the outer peripheries of the second and third rollers and blocking the front area in the rotating direction of both rollers at the contact area between the first and second rollers, so that the ink droplets and particles generated in the contact area of both roller are contained in a space enclosed by the first through fourth rollers by the rotation of the first and second rollers.

DETAILED DESCRIPTION OF THE PREFERRED EMBODIMENTS

Figure 1:
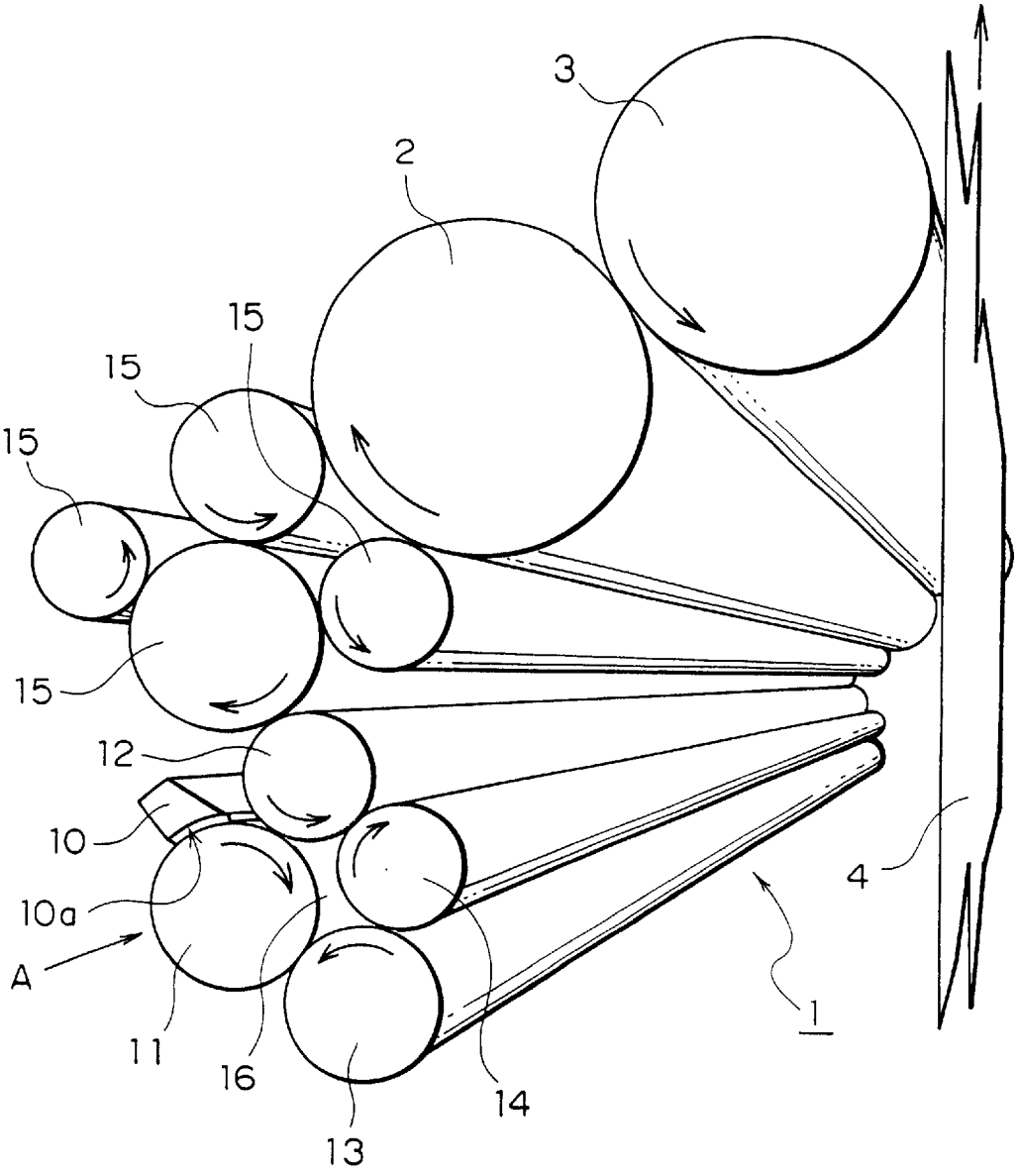
FIG. 1 is a perspective view of assistance in explaining the construction of an inking device embodying the present invention.
Figure 2:
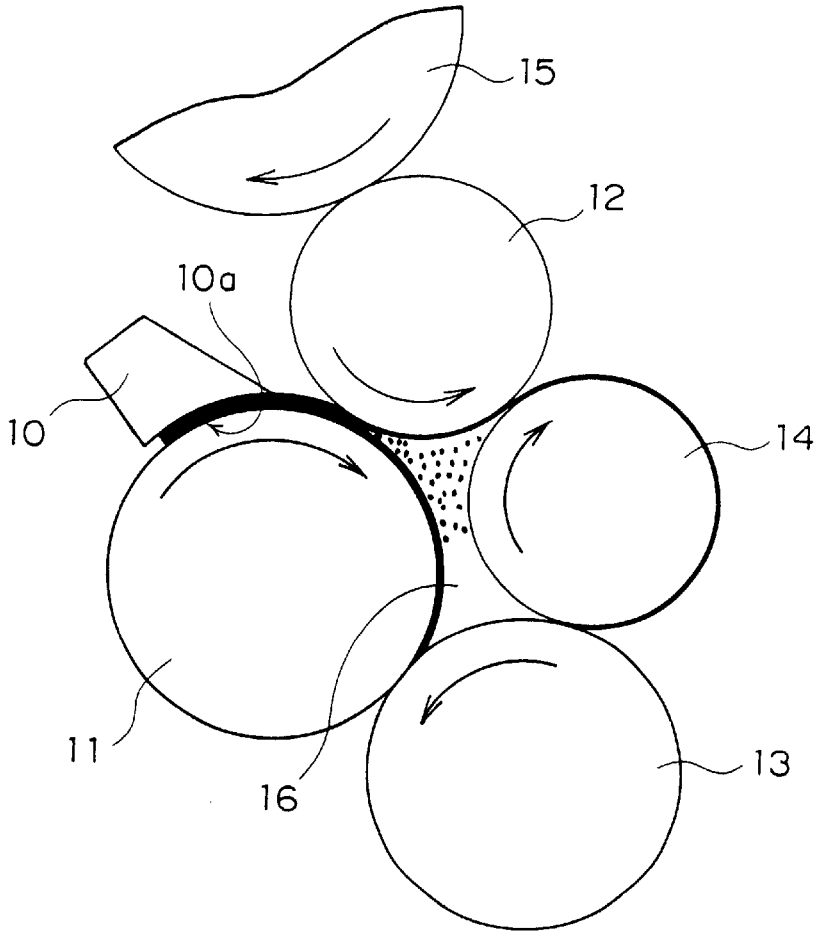
FIG. 2 is a fragmentary view taken in the direction of the arrow A in FIG. 1 that is of assistance in explaining the state where ink droplets and particles are scattered and suspended in the essential part of the inking device according to the present invention.
Figure 3:
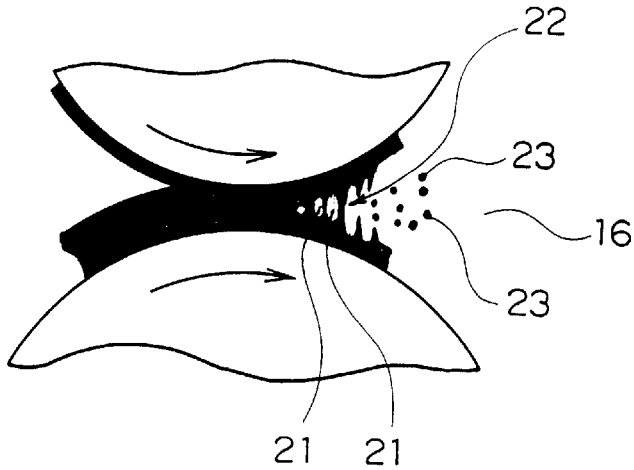
FIG. 3 is a diagram of assistance in explaining the state where ink droplets and particles are generated in an embodiment of the present invention.

FIG. 1 is a perspective view of assistance in explaining the construction of an inking device embodying the present invention, FIG. 2 a fragmentary view taken in the direction of the arrow A in FIG. 1 that is of assistance in explaining the state where ink droplets and particles are scattered and suspended in the essential part of the inking device according to the present invention, and FIG. 3 a diagram of assistance in explaining the state where ink droplets and particles are generated in an embodiment of the present invention.

In FIGS. 1 through 3, an offset printing press has an inking device 1 for feeding ink to printing areas on a printing plate provided on the outer periphery of a plate cylinder 2, and a dampening device (not shown in the figures since it has no relations with the present invention), in which the ink fed to the printing area on the printing plate is printed on a paper web 4 interposed between a blanket cylinder 3 and a pressure cylinder (not shown) via a blanket surface provided on the outer periphery of the blanket cylinder 3.

The inking device 1 comprises an ink rail 10, a plurality of ink pumps (not shown) for feeding to an ink feeding surface 10*a* of the ink rail 10 an amount of ink sufficient to cover the size of an image on the surface of the printing plate corresponding to a predetermined longitudinal length of the ink rail 10, a first roller 11 provided in such a manner that part of the outer periphery thereof faces the ink feeding surface 10*a* of the ink rail 10 in the close vicinity thereof, a second roller 12 provided on the downstream side of the first roller 11 in the ink feeding process, that is, on the side of the printing plate, and coming in contact with the first roller 11 on the downstream side in the rotating direction of the position where the outer periphery of the first roller 11 faces the ink feeding surface 10*a,* a third roller 13 provided in such a manner as to come in contact with the first roller 11 on the downstream side in the rotating direction of the position where the outer periphery of the first roller 11 is in contact with the second roller 12, and a fourth roller 14 provided in contact with both the outer peripheries of the second and third rollers 12 and 13 in such a manner as to block the front portion in the rotating direction of both rollers at the contact area of the first and second rollers. The inking device 1 also has several (four in the figures) downstream rollers 15, 15, - - - provided with the outer peripheries sequentially in contact with each other on the downstream side of the second roller 12 in the ink feeding process.

A closed space 16 is formed by the first roller 11, the second roller in contact with the first roller 11, the third roller 13 in contact with the first roller 11, and the fourth roller 14 in contact with both the second and third rollers 12 and 13.

In the present invention having the aforementioned construction, the ink fed to the ink rail 10 by the ink pumps fills up a space between the ink feeding surface 10*a* of the ink rail 10 and the outer periphery of the first roller 11, as shown in FIG. 2, reaches the contact area of the first and second rollers 11 and 12 by the rotation of the first roller 11, and part of the ink is transferred and deposited on the outer periphery of the second roller 12 as it passes over the contact area, breaking up into the outer peripheries of the first and second rollers 11 and 12. The ink transferred and deposited onto the outer periphery of the second roller 12 is sequentially transferred and deposited onto the outer peripheries of the downstream rollers 15, fed to the printing areas on the printing plate provided on the outer periphery of the plate cylinder 2, and printed on the paper web 4 via the blanket surface provided on the outer periphery of the blanket cylinder 3.

During the breakup of ink, the pressure in the ink film is sharply reduced on the downstream side in the rotating direction of the contact area of the first and second rollers 11 and 12, resulting in a cavity 21 as shown in FIG. 3. As the gap between the outer peripheries of the first and second rollers 11 and 12 is increased by the rotation of the first and second roller 11 and 12, the cavity 21 grows, and eventually the wall of the cavity 21 is stretched into a filament shape and cut apart. When the cutting of the ink filament 22 takes place simultaneously at more than two locations, the ink between the rollers is reduced into ink droplets or particles 23, 23, - - - , which are released into the air in the space 16. The ink droplets and particles 23, 23, - - - released into the air, which are charged with surface static charge, are suspended in the air while electrically repulsing each other.

Since the space 16 into which the ink droplets and particles 23, 23, - - - are released is a space enclosed by the first, second, third and fourth rollers 11, 12, 13 and 14, the ink droplets and particles 23, 23, - - - do not escape from the space 16, depositing on the outer periphery surface of any of the first through fourth rollers 11 through 14 over time, returning to the inking device 1.

The breakup of ink does occur not only at the contact area of the first and second rollers 11 and 12, but also at the contact areas of other rollers. At the contact areas of rollers other than the first and second roller 11 and 12, however, the thickness of the ink from on the roller outer periphery is too small to generate ink droplets and particles.

As described above, the present invention makes it possible to prevent the ink droplets and particles produced at the contact area of the first and second rollers 11 and 12 where the thickness of the ink film on the outer periphery of the rollers is considerably larger than that on the contact areas of other rollers from being scattered and suspended by providing a simple mechanical construction of forming an enclosed space by arranging first through fourth rollers 11 through 14, and recover the ink droplets and particles completely to the inking device.

Thus, contamination of the printing press, the surroundings thereof, and the air around the printing press by the ink droplets and particles scattered and suspended as a result of the breakup of ink at the contact area of the rollers can be eliminated, and the printing working environment can be kept clean. In addition, roller arrangement in the inking device is so simple that the state of contact of rollers can be easily adjusted, and rollers themselves can be easily exchanged.

Furthermore, there are no fire hazards because the inking device according to the present invention uses no means having special risks, such as high voltage. No special maintenance measures, such as removing ink from any components of the inking device, are required because ink is caused to deposit on the rollers for recovery to the inking device. All this results in good workability and operability.

What is claimed is:

1. An inking device for supplying ink to be fed to a printing plate on a cylinder via a group of rollers arranged sequentially in contact with each other in an ink feeding process, the device comprising:

an ink rail being unrotatably disposed upstream in the ink feeding process and having an ink feeding surface;

a first roller whose outer periphery partly faces the ink feeding surface of the ink rail, said outer periphery being spaced from the ink feeding surface by a gap, said outer periphery receives ink directly out of the ink feeding surface, said ink rail filling said gap between said ink feeding surface and said outer periphery of said first roller with the ink;

a second roller that is disposed downstream of the first roller in the ink feeding process and in contact with the outer periphery of the first roller on the downstream side in the rotating direction from the position at which the first roller faces the ink feeding surface of the ink rail, said first roller moving substantially all the ink from said inking rail on said outer periphery of said first roller to said contact with said second roller;

a third roller that is in contact with the first roller on the downstream side in the rotating direction from the position at which the second roller comes in contact with the outer periphery of the first roller on the downstream side in the rotating direction, and a fourth roller that is in contact with the outer peripheries of the second and third rollers and blocks the front side in the rotating direction of the first and second rollers at the position where the first and second rollers are in contact with each other;

said first, second, third and fourth rollers are arranged to define a space therebetween which is enclosed by said first, second, third, and fourth rollers, wherein ink droplets and ink particles produced at a contact area of said first and second rollers by rotation thereof are contained in said space.

2. An inking device as set forth in claim 1, further comprising:

downstream rollers each having an outer periphery, the downstream rollers being arranged such that the second roller comes into contact with the outer periphery of one of the downstream rollers on the downstream side of the second roller, and thereby ink is fed to the printing plate on the plate cylinder.

3. An inking device as set forth in claim 1, wherein:

any of the first, second, third, and fourth rollers accept deposits on their outer periphery thereof from ink droplets and ink particles which are introduced into the enclosed space.

4. A device in accordance with claim 1, further comprising:

a downstream roller rotatably arranged with an outer surface in contact with said second roller, said downstream roller receiving ink from saidink rail exclusively through contact with said second roller.

5. A device in accordance with claim 4, further comprising:

a plurality of sub-rollers, each having an outer surface rotatably arranged in contact with said downstream roller; a plate cylinder rotatably arranged with an outer surface in contact with at least one of said plurality of sub-rollers, said plate cylinder receiving ink from said inking unit exclusively through said second and downstream rollers;

wherein said fourth roller only contacts said second and third rollers;

said third and fourth rollers are not in direct contact with said downstream roller; and said ink feeding surface feeds an amount of ink sufficient to cover an image to be printed.

6. An inking device comprising:

an inking unit feeding ink through an ink surface;

a first roller rotatably arranged with an outer surface passing opposite said inking unit at a first position, said outer surface of said first roller being spaced from said ink surface, said inking unit filling a space between said ink surface and said outer surface of said first roller with the ink;

a second roller rotatably arranged with an outer surface in contact with said first roller at a second position, said second position being downstream of said first position in a rotation direction of said first roller, said first roller moving substantially all the ink from said linking unit on said outer surface of said first roller to said second position;

a third roller rotatably arranged with an outer surface in contact with said first roller at a third position, said third position being downstream of said second position in said rotational direction of said first roller;

a fourth roller rotatably arranged with an outer surface in contact with said second and third rollers to define a closed area with said first, second and third rollers.

7. A device in accordance with claim 6, wherein:

said inking unit includes an ink rail that is stationary.

8. A device in accordance with claim 7, wherein:

said ink rail and said rollers each have a longitudinal axis substantially parallel to each other, said rollers being rotatable about their respective longitudinal axis, said ink rail being fixed about its longitudinal axis.

9. A device in accordance with claim 8, wherein:

said ink rail is non-rotatable about its longitudinal axis.

10. A device in accordance with claim 7, wherein:

said ink feed surface does not extend completely around said ink rail, said ink feed surface is constantly arranged facing said first roller.

11. A device in accordance with claim 7, wherein:

said first roller receives ink directly from said ink surface.

12. A device in accordance with claim 6, further comprising:

a downstream roller rotatably arranged with an outer surface in contact with said second roller, said downstream roller receiving ink from said inking unit exclusively through contact with said second roller.

13. A device in accordance with claim 12, further comprising:

a plurality of sub-rollers, each having an outer surface rotatably arranged in contact with said downstream roller; a plate cylinder rotatably arranged with an outer surface in contact with at least one of said plurality of sub-rollers, said plate cylinder receiving ink from said inking unit exclusively through said second and downstream rollers;

wherein said outer surface of said fourth roller only contacts said second and third rollers; and said third and fourth rollers are not in direct contact with said downstream roller.

14. An inking device comprising:

an inking unit feeding an amount of ink to cover an image to be printed;

a first roller rotatably arranged with an outer surface passing opposite said inking unit at a first position;

a second roller rotatably arranged with an outer surface in contact with said first roller at a second position, said second position being downstream of said first position in a rotational direction of said first roller;

a third roller rotatably arranged with an outer surface in contact with said first roller at a third position, said third position being downstream of said second position in said rotational direction of said first roller;

a fourth roller rotatably arranged with an outer surface in contact with said second and third rollers to define a closed area with said first, second and third rollers;

a downstream roller rotatably arranged with an outer surface in contact with said second roller, said downstream roller receiving ink from said from said inking unit exclusively through contact with said second roller.

15. A device in accordance with claim 14, further comprising:

a plate cylinder receiving ink from said linking unit exclusively through said second and downstream rollers.

16. A device in accordance with claim 15, wherein:

a plurality of sub-rollers are arranged between said downstream roller and said plate cylinder.

17. A device in accordance with claim 14, wherein:

said fourth roller only contacts said second and third rollers.

18. A device in accordance with claim 14, wherein:

said third and fourth rollers are not in direct contact with said downstream roller.

19. A device in accordance with claim 14, wherein:

said outer surface of said first roller is spaced from said inking unit.

* * * * *